US008656685B2

(12) United States Patent
Wu

(10) Patent No.: US 8,656,685 B2
(45) Date of Patent: Feb. 25, 2014

(54) STRUCTURAL MEMBERS WITH IMPROVED DUCTILITY

(75) Inventor: Yu-Fei Wu, Hong Kong (CN)

(73) Assignee: City University of Hong Kong, Kowloon (HK)

( * ) Notice: Subject to any disclaimer, the term of this patent is extended or adjusted under 35 U.S.C. 154(b) by 1842 days.

(21) Appl. No.: 11/075,023

(22) Filed: Mar. 8, 2005

(65) Prior Publication Data

US 2006/0201099 A1 Sep. 14, 2006

(51) Int. Cl.
*E04B 2/00* (2006.01)

(52) U.S. Cl.
USPC ..... 52/847; 52/223.8; 52/414; 52/834; 52/600

(58) Field of Classification Search
USPC ..... 52/223.4, 223.8, 231, 236.4, 414, 252, 52/433, 600, 649.2, 649.3, 650.1, 831, 52/DIG. 9, FOR. 121, 834, 847; 428/625, 428/33, 67, 189, 221, 540, 217
See application file for complete search history.

(56) References Cited

U.S. PATENT DOCUMENTS

| | | | | | |
|---|---|---|---|---|---|
| 2,597,751 | A * | 5/1952 | Ruge | 338/5 |
| 2,950,576 | A * | 8/1960 | Rubenstein | 52/223.13 |
| 3,478,481 | A * | 11/1969 | Schuppisser et al. | 52/432 |
| 3,879,908 | A * | 4/1975 | Weismann | 52/309.5 |
| 4,030,265 | A * | 6/1977 | Allgood | 52/600 |
| 4,229,497 | A * | 10/1980 | Piazza | 428/71 |
| 4,423,979 | A * | 1/1984 | Brown | 404/69 |
| 4,655,016 | A * | 4/1987 | Jacob | 52/169.1 |
| 5,111,627 | A * | 5/1992 | Brown | 52/126.5 |
| 5,116,653 | A * | 5/1992 | Frandina | 428/58 |
| 5,391,226 | A * | 2/1995 | Frankowski | 106/696 |
| 5,440,845 | A * | 8/1995 | Tadros et al. | 52/309.12 |
| 6,012,256 | A * | 1/2000 | Aschheim | 52/167.1 |
| 6,389,775 | B1 * | 5/2002 | Steiner et al. | 52/600 |
| 6,460,213 | B1 * | 10/2002 | Flint et al. | 14/73 |
| 6,694,690 | B2 * | 2/2004 | Li et al. | 52/396.04 |
| 6,735,916 | B2 * | 5/2004 | Peshkam et al. | 52/650.1 |
| 6,763,646 | B1 * | 7/2004 | Bonomo | 52/649.6 |
| 7,232,605 | B2 * | 6/2007 | Burgueno et al. | 428/294.7 |
| 7,856,778 | B2 * | 12/2010 | Pantelides et al. | 52/309.1 |
| 2004/0187235 | A1 * | 9/2004 | Elias et al. | 14/73.1 |
| 2005/0013982 | A1 * | 1/2005 | Burgueno et al. | 428/292.1 |
| 2006/0150538 | A1 * | 7/2006 | Thomas | 52/167.3 |
| 2007/0175127 | A1 * | 8/2007 | Tanaka | 52/223.13 |

* cited by examiner

*Primary Examiner* — Robert Canfield
*Assistant Examiner* — Matthew Gitlin
(74) *Attorney, Agent, or Firm* — Heslin Rothenberg Farley & Mesiti P.C.

(57) ABSTRACT

The present invention provides a method of improving the ductility of a structural member, such as a reinforced concrete beam or column, by providing a region of increased compression yielding in the compression zone of the plastic hinge region or nearby. This can be achieved by using ductile compressive material in the compression zone, or by forming a mechanism provided in the compression zone to provide the ductile compression zone.

3 Claims, 7 Drawing Sheets

FIG. 9
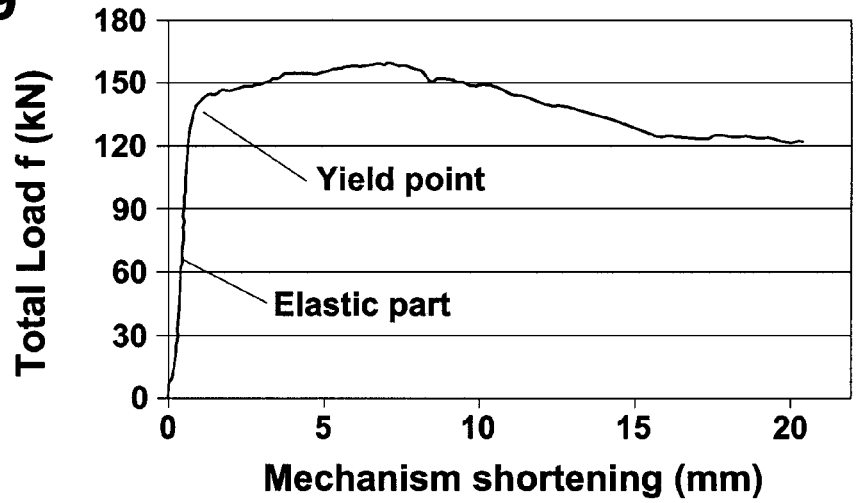
FIG. 10a
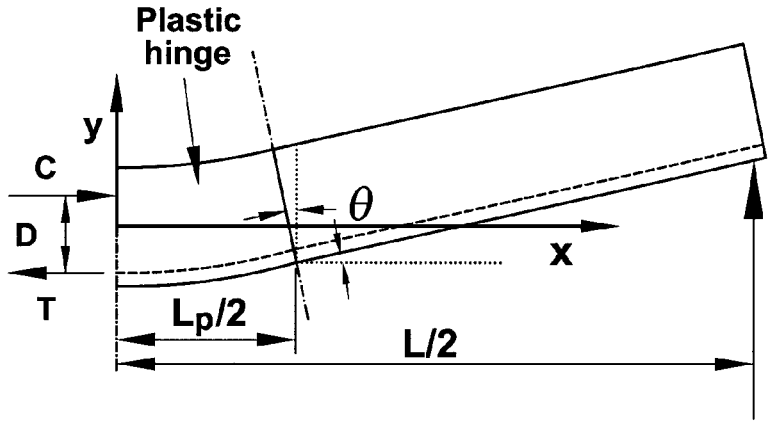
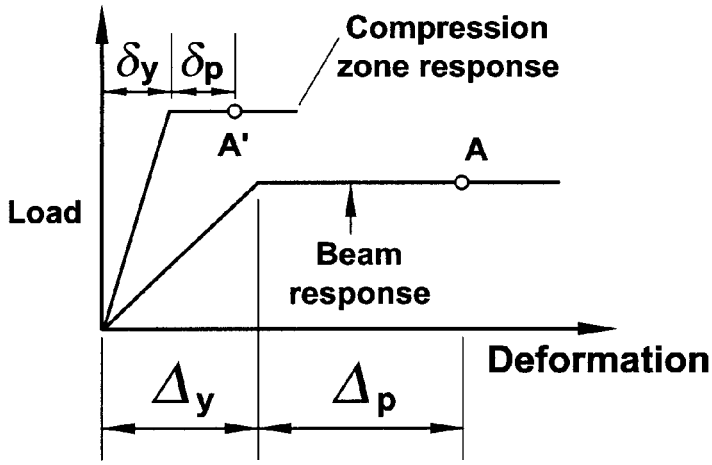
FIG. 10b

STRUCTURAL MEMBERS WITH IMPROVED DUCTILITY

FIELD OF THE INVENTION

This invention relates to structural members, such as for example reinforced concrete beams and columns, and in particular to such structural members that are provided with improved ductility.

BACKGROUND OF THE INVENTION AND PRIOR ART

Concrete is a brittle material. Concrete structures rely largely on the deformation and yielding of the tensile reinforcement to satisfy the ductility demand. The widespread application of high strength steel reinforcement in concrete structures has a significant drawback from a ductility point of view due to a lower degree of strain hardening and smaller ultimate elongation of the high strength steel. The application of fiber reinforced polymer (FRP) reinforcement encounters a similar problem, as FRPs have a low strain capacity and linear elastic stress-strain behavior up to rupture without yielding. The ductility of concrete members reinforced with non-ductile bars, especially FRP reinforced concrete (RC) members, has been a major concern in the studies of reinforced concrete structures in recent years.

Conventional RC members reinforced with ductile bars also have ductility problems when the failure is caused by the compressive crushing of concrete in which the tensile reinforcement does not yield. This occurs in over-reinforced RC beams and RC columns with a high axial load level. In this case the ductility and deformability of RC members are significantly reduced, although significant confinement to concrete can partially offset this reduction. The more the tensile reinforcement in an RC beam, the less the tensile reinforcement deforms and hence the lower the deformability and ductility of the member. Similarly, the higher the axial load level in an RC column, the lower the ductility. Furthermore, the use of more brittle high strength concrete (HSC), which has been increasing in a fast rate over the last two decades, has a similar detrimental side-effect on the ductility of reinforced concrete members especially for concrete columns.

Ductility of structures is important to ensure large deformation and give sufficient warning while maintaining an adequate load carrying capacity before structural failure, so that total collapse may be prevented and lives saved. Ductility is also the basis of modern structural design approaches (e.g. moment redistribution). In seismic design, in particular, ductility becomes an extremely important consideration. The issue of ductility and methods of increasing ductility is one of the most active areas in the study of concrete structures. There are a number of existing approaches used to improve the structural ductility of FRP reinforced concrete members, some of them are equally applicable to steel reinforced concrete members:

Providing confinement to concrete. Confinement increases ductility/deformability of concrete, however, this method cannot avoid the rupture of non-ductile bars for under-reinforced beams. For over-reinforced beams or columns with significant axial load, heavy and excessive confinement reinforcement is usually needed to achieve the ductility requirement;

Placing prestressed reinforcement in layers and design the effective prestress in each layer so as to provide a step-by-step progressive failure with increasing deformation. This method relies on the progressive fracture of FRP reinforcement to avoid sudden complete fracture of tension reinforcement;

Using partially prestressed concrete where prestressed FRP tendons are combined with conventional steel reinforcement to allow sufficient flexibility to achieve better ductility;

Using unbonded tendons so that more deformation can be achieved on the tension side as the deformation of the tendons over the whole unbonded length can be utilized. However, this implies the use of perfect anchorages that can sustain fatigue loading. Furthermore, external tendons can be very vulnerable to vandalism, and should they fail they will release an enormous amount of elastic energy that can be devastating;

Designing the interface between the FRP reinforcement and the concrete so that a bond failure is triggered when the stress in the tendons reaches a threshold level, thus changing a bonded tendon configuration to an unbonded tendon configuration; and Designing the cross-section of a member to proportionate the reinforcement in order to take the advantage of the full strain capacity of concrete simultaneously with that of the reinforcement.

The success of such methods will vary depending on the specific application. However they are often considered either too complicated, too time consuming, overly expensive, or not very effective (i.e. limited increase in ductility).

Curvature, and hence flexural deformation, are due to tensile and compression straining at a cross-section. When tension yielding/deformation is unavailable, another avenue of achieving ductility/deformability is by compression yielding/deformation. In principle, all the methods of achieving flexural ductility/deformability of RC members must fall into these two categories.

It would be desirable to produce improved or alternative flexural members that overcame the problems associated with flexural members in the prior art.

SUMMARY OF INVENTION

The applicants have discovered that replacing the concrete in the compression zone of the plastic hinge with a strong but more ductile material or mechanism leads to an increase in ductility of a flexural member.

According to the present invention therefore there is provided a flexural member having a plastic hinge region or nearby region defined by tension and compression zones when subject to a bending moment, wherein said compression zone is provided with means for increasing the compression yielding of the compression zone.

In one broad aspect of the present invention there is provided a flexural member wherein at least a portion of the material in the compression zone of the plastic hinge or near the plastic hinge comprises a ductile compressive material. In particular the flexural member may comprise concrete, for example FRP bar or steel bar reinforced concrete, such as a concrete structural member such as a beam or column. Preferably the ductile compressive material comprises elasto-plastic or nearly elasto-plastic material. Possible materials for the ductile compressive material include metallic materials such as steel and alloys, cementitious material, plastics, elastomeric materials such as rubber, rubber cement material, composite material or combinations thereof.

Another method of producing a very ductile compression zone is by providing or forming holes (such as voids or bubbles) inside normal concrete or inside other materials such as plastic materials, metallic materials, composite materials or other materials.

The ductile compressive material is prefabricated and cast or installed into said flexural member. The ductile compressive material can also be cast directly into said flexural member. Preferably the flexural member may further comprise additional compression bars or compression plates in the compression yielding zone.

Viewed from another broad aspect of the invention there is provided a flexural member wherein at least a portion of the material in the compression zone of the plastic hinge or near the plastic hinge is occupied by a mechanism that provides the flexural member with a ductile compression zone. In particular the flexural member may comprise concrete, for example FRP bar or steel bar reinforced concrete, such as a concrete structural member such as a beam or column.

Preferably the mechanism is made from steel or other metallic materials, FRP, composite, plastic, cementitious material, elastomeric material or combinations thereof, and the mechanism may be encased in a protective material such as a lightweight concrete or other low strength materials.

The encased mechanism may be cast or installed into the flexural member to form a ductile compression zone.

Viewed from another broad aspect the invention also provides a method of modifying a flexural member comprising casting an amount of ductile compressive material into the compression zone of the plastic hinge or near the plastic hinge of the flexural member.

Viewed from another broad aspect the invention also provides a method of modifying a flexural member comprising inserting a ductile compressive mechanism into the compression zone of the plastic hinge of the flexural member or nearby to the plastic hinge.

The invention may also broadly be said to consist in any alternative combination of features as described or shown in the accompanying examples. Known equivalents of these features not expressly set out are nevertheless deemed to be included.

BRIEF DESCRIPTION OF THE DRAWINGS

Some embodiments of the invention will now be described by way of example and with reference to the accompanying drawings, in which:

FIG. 6*a* shows a graph of the load vs. mid-span displacements of the flexural members tested in the Examples, while

FIG. 9 shows a graph which compares the total load on the beam in Example 3 versus the amount of shortening of the ductile compressive mechanism.

FIG. 10*a* provides a schematic view of the deformation of a structural beam, and FIG. 10*b* depicts a graph comparing the deformation of a structural beam with the deformation of the ductile compressive zone of the same beam.

DETAILED DESCRIPTION OF PREFERRED EMBODIMENTS

It is known that when large flexural deformation occurs in a structural member (hereafter referred to as a "flexural member"), the plastic deformation is mainly concentrated in a small area called the "plastic hinge" zone that has a limited length. When large rotations of the plastic hinge cannot be achieved through elongation or tensile yielding of the reinforcement on the tension side, the other way to achieve it is by shortening or compression yielding on the opposite compression side.

Figure 1A:
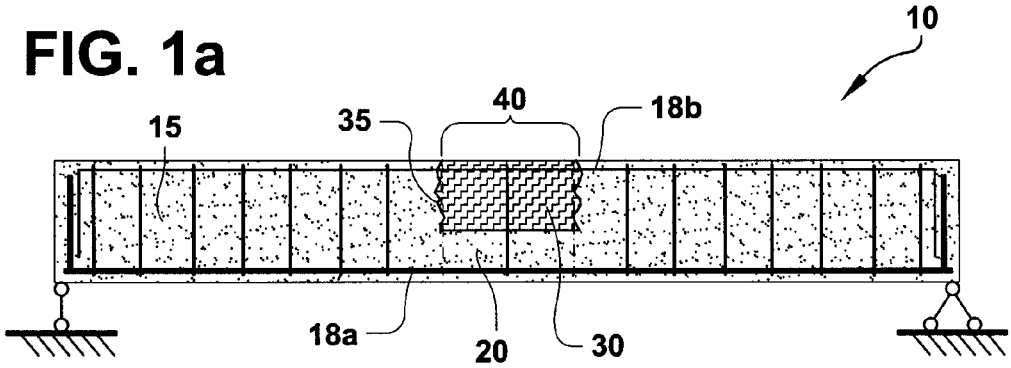
FIGS. 1*a* to 1*f* show schematic longitudinal and cross sections of different embodiments of one aspect of the present invention.
Figure 1B:
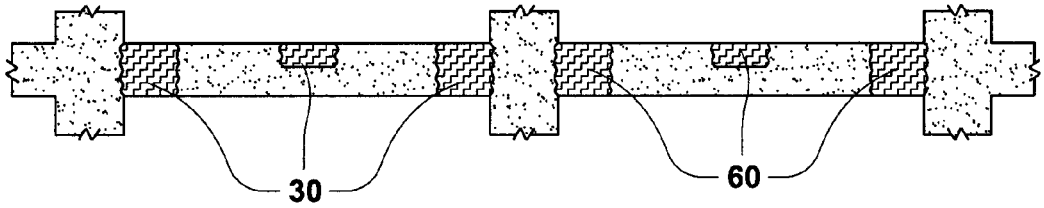
Figure 1C:
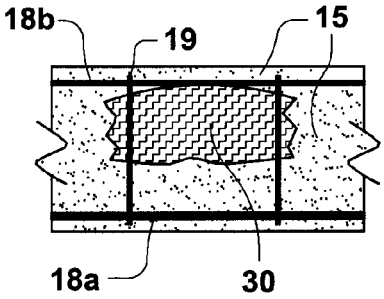
Figure 1D:
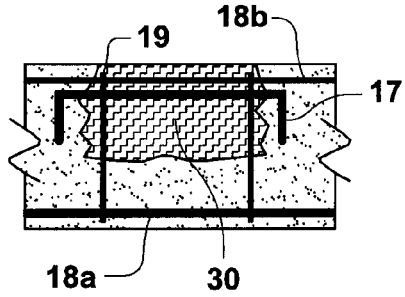
Figure 1E:
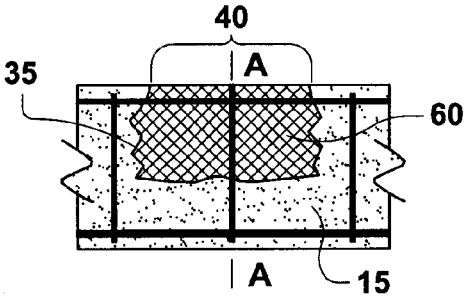
Figure 1F:
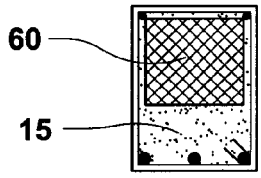
Figure 2A:
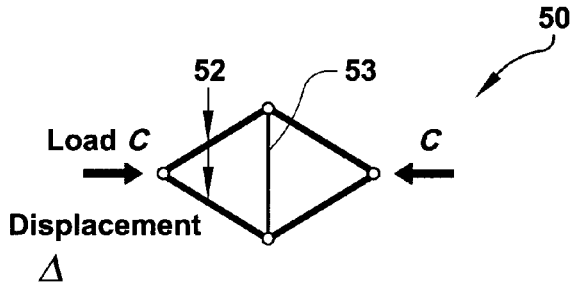
FIGS. 2*a* to 2*c* show side views of embodiments of a second aspect of the invention.

As shown in FIGS. 1 and 2, the present invention provides additional ductility to a flexural member 10 through the new concept of compression yielding by utilizing a compression yielding device. Means for achieving increased compression yielding in a plastic hinge 20 of a flexural member 10 include the use of a compression yielding device, in particular:

1) A compression yielding device comprising ductile compression material 30 that replaces concrete 15 within ductile compression zone 40 (such as that shown in FIG. 1); and
2) A compression yielding device comprising a ductile mechanism 50 within the compression zone 40 (such as that shown in FIG. 1*e* and FIG. 2).

Both types of compression yielding devices should satisfy the following general principles: i) deforming elastically (or almost elastically) at the serviceability limit state to ensure low creep deformation, sufficient rigidity and other good working conditions; ii) deforming plastically (or almost plastically) at the ultimate limit state to ensure sufficient ductility; and iii) the total compressive strength C is not greater than the total tensile strength T to ensure no tensile breaking of the non-ductile bars.

It would be desirable to place the ductile compression material 30 or mechanism 50 at the plastic hinge location 20. However, the locations of plastic hinges may vary with different flexural members. Nevertheless, the ductile compression zone 40 need not coincide exactly with the position of the maximum moment. In fact, the ductile compression zone 40 acts as a fuse in the structural system, and when excessive loading condition occurs, the fuse will be triggered and force the structural system to deform in a (more or less) plastic manner to avoid abrupt reinforcement rupture or concrete crushing.

Referring to FIGS. 1*a*-1*d*, one means of achieving compression yielding is by casting a block of elasto-plastic (ductile) material 30 into the compression zone 40 of the plastic hinge 20. Good deformability of materials may come together with the high tendency to creep that will result in significant long-term deflections. In such a case, an additional elastic compression component, such as additional normal concrete 15 (see FIG. 1*c*) or additional compression bars or plates 17 (see FIG. 1*d*) can be used in the plastic hinge 20 on top of the compression zone 40 to provide sufficient elasticity and rigidity at service loads. The additional elastic compression component will give up at ultimate load (by crushing of the top concrete 15 in case of FIG. 1*c* or by buckling of the bars or plate 17 in case of FIG. 1*d*) and pass the compression load to the compressible material 30 so that sufficient ductility can be achieved. Transition from these two loading stages should be as smooth as possible, and mechanisms such as plastic buckling instead of elastic buckling can be utilized. In a plastic buckling of bar 17, the compression strength of bar 17 reduces gradually but the compressive strength in the ductile material 30 picks up so that the total compressive strength can be maintained to a nearly constant value.

Ductile block(s) 60 can be prefabricated and cast into beam 10. As shown in FIGS. 1*a*-1*e*, the interfaces 35 between the ductile material 30 and the concrete 15 may be roughened to ensure a good bond. Referring to FIGS. 1*a*, 1*c* & *d*, the addition of top and bottom reinforcement bars 18*a* and 18*b* and stirrups 19 surrounding the ductile block 60, separation between the concrete 15 and the ductile material 30 can be avoided.

Referring to FIG. 1*e* and FIG. 2, the other means of achieving compression yielding is by using a ductile mechanism 50. Both steel and FRP materials can be used to design and make ductile mechanism 50. There is no technical problem to design and make a steel mechanism 50 and the requirement is that it should be as simple and as inexpensive as possible. Examples of a steel mechanism 50 that has been tested in such a way is shown in FIG. 2. A similar mechanism 50 made from FRP material may be used in special cases where non-magnetic and non-corrosive material is required. The mechanism 50 can be encased into a protective material such as light weight concrete that may form a precast block 60. This precast block 60 can be then cast into the beam 10 to form a ductile compression zone 40 as shown in FIG. 1*e*.

The compression yielding only takes place inside the compression yielding zone. In order to achieve compression yielding in the plastic hinge 20, the concrete 15 on both sides of the compression yielding zone should be stronger than that of the compression yielding zone. On the other hand, tension yielding of reinforcement should be avoided in order to avoid breaking of the non-ductile bars 18*a*. As a result, the plastic deformation takes place on the compression side and is confined inside the compression yielding zone. Hence the plastic hinge length 55 is simply the length of the compression yielding zone. This makes the determination of the plastic hinge length 55 much simpler than that for conventional reinforced concrete (RC) members.

It is generally accepted in the literature that the plastic hinge length 55 of RC beams and columns is mainly governed by three factors: member length, diameter and yield strength of the tension reinforcing bars. This is reasonable for members in which the tensile deformation of bars contributes to most of their flexural deformation, e.g. the under-reinforced beams or columns with low axial load level. For members without significant tensile yielding, such as over-reinforced beams and columns with high axial load level, the properties of the tensile reinforcement apparently have no effect on the extent of yielding and the plastic hinge length 55. This conclusion can be seen from the compression yielding system where the extent of plasticity and the plastic hinge length 55 is determined by the properties of the compression zone instead of that of the tension reinforcement. This analysis reveals the possible deficiency in the existing model of the plastic hinge length 55. Apparently, the plastic hinge length 55 is largely governed by the extent of tension yielding for under-reinforced beam and columns with low axial load level. For over-reinforced beam or columns with high axial load level in which no tension yielding occurs, the extent of compression plasticity, which is ignored in the existing model, plays an important role in the plastic hinge length 55. Consequently both the tension and compression material properties would be important for members with both tension and compression yielding. A plastic hinge model that features all these factors is yet to be found.

For compression yielding beams, the ductility of the overall beam is directly related to the ductility of the compression yielding zone. This relation can be derived mathematically. For half of a simply supported beam as shown in FIG. 10(*a*), the mid-span displacement Δ relative to the supports is given by $$\begin{aligned}\Delta &= \int_0^{L/2}\left(\int_0^x \kappa dx\right)dx \\ &= \int_0^{L/2}\left(\int_0^x (\kappa_e+\kappa_p)dx\right)dx \\ &= \int_0^{L/2}\left(\int_0^x \kappa_e dx\right)dx + \int_0^{L/2}\left(\int_0^x \kappa_p dx\right)dx \\ &= \Delta_e + \Delta_p\end{aligned} \tag{2}$$

where κ, $\kappa_e$, and $\kappa_p$, are the total, elastic and plastic curvature, respectively; L is the span of the beam; $\Delta_e$ is the displacement due to the elastic deformation; and $\Delta_p$ is the displacement due to the plastic deformation.

The elastic deformation $\Delta_e$ can be calculated with the conventional reinforced concrete theory. When plastic deformation occurs, the elastic component reaches its maximum value of $\Delta_y$, or $\Delta_e=\Delta_y$. For plastic deformation, it is generally accepted in the literature that the plasticity concentrates in the plastic hinge zone that has a limited length of $L_p$ (Paulay and Priestley 1992). Therefore, $\kappa_p=0$ outside the plastic hinge zone. Assuming that the plastic curvature $\kappa_p$ is constant inside the plastic hinge zone, then $$\begin{aligned}\Delta_p &= \int_0^{L/2}\left(\int_0^x \kappa_p dx\right)dx \\ &= \kappa_p\left(\int_0^{L_p/2}\left(\int_0^x dx\right)dx + \int_{L_p/2}^{L/2}\left(\int_0^{L_p/2} dx\right)dx\right) \\ &= \kappa_p\left(\int_0^{L_p/2} x dx + \int_{L_p/2}^{L/2}(L_p/2)dx\right) \\ &= \frac{L_p}{2}\cdot\kappa_p\cdot\left(\frac{L}{2}-\frac{1}{4}L_p\right)\end{aligned} \tag{3}$$

In fact Eq. 3 can be obtained directly from the geometric relation in FIG. 10, which shows $$\begin{aligned}\Delta_p &= \theta_p\cdot L_{ave} \\ &= \frac{L_p}{2}\cdot\kappa_p\cdot\left(\frac{L}{2}-\frac{1}{4}L_p\right)\end{aligned} \tag{4}$$

where $\theta_p$ is the plastic rotation of the plastic hinge, and $\theta_p=\eta_p\cdot L_p/2$; and $L_{ave}$ is the length from the support of the member to the centre of the plastic hinge (Paulay and Priestley 1992).

In the plastic deformation stage, the rotation of the plastic hinge θ is caused by the elastic and plastic shortening of the mechanism, $\delta_y$ and $\delta_p$, respectively, as well as the elongation of the tension bars $\delta_t$, or $$\theta = \frac{1}{2}\cdot\frac{\delta_y+\delta_p+\delta_t}{D} = \frac{1}{2}\cdot\frac{\delta_y+\delta_t}{D}+\frac{1}{2}\cdot\frac{\delta_p}{D} = \theta_y+\theta_p \quad (5)$$

where D is the distance between the location where the compression displacements $\delta_y$ and $\delta_p$ are measured and that of the tension bars. Because only half the plastic hinge length contributes to the rotation relative to mid-span, the summation of the above three displacements, which are taken over the whole plastic hinge length, is divided by two in the equation. With an ideal elasto-plastic model as shown in FIG. 10(*b*), both the external load on the beam and the internal compression force at the compression zone keeps constant at the plastic deformation stage. The elastic deformation components, $\delta_y$ and $\delta_t$, and hence the elastic rotation $$\theta_y = \frac{1}{2}\cdot\frac{\delta_y+\delta_t}{D}$$

keep unchanged on the yield plateau. The plastic rotation $\theta_p$ is given by $$\theta_p = \frac{\delta_p}{2D} \quad (6)$$

From FIG. 10(*b*), the ductility factor of the beam, $\mu_b$, at a point A of the yield plateau is given by $$\mu_b = \frac{\Delta_y+\Delta_p}{\Delta_y} = 1+\frac{\Delta_p}{\Delta_y} \quad (7)$$

or $$\Delta_p = (\mu_b-1)\Delta_y$$

Substituting Eqs. 6 and 7 into Eq. 4 gives $$\delta_p = \frac{4(\mu_b-1)\cdot\Delta_y\cdot D}{L-\frac{L_p}{2}} \quad (8)$$

Also from FIG. 10(*b*), the ductility factor $\mu_c$ of the compression yielding zone at point A' of the yield plateau that corresponds to point A of the beam response curve, is given by $$\mu_c = \frac{\delta_y+\delta_p}{\delta_y} = 1+\frac{\delta_p}{\delta_y} \quad (9)$$

Substituting *Eq.* 9 into *Eq.* 8 yeilds $$\mu_c = 1+\frac{\Delta_y}{\delta_y}\cdot\frac{4D\cdot(\mu_b-1)}{\left(L-\frac{L_p}{2}\right)} \quad (10)$$

Equation 10 relates the ductility demand of the compression yielding zone to the required ductility factor $\mu_b$ of the beam. The value of $\delta_y$, can be determined from test result of the mechanism (see FIG. 4) or from elastic calculation. The yield deformation of the beam, $\Delta_y$, can be calculated by elastic theory at the load corresponding to the yield moment $M_y$. The yield moment of the beam is reached at the onset of yielding of the compression zone or at the onset of the values of $\delta_y$. This yield moment $M_y$ is simply given by the yield force of the compression mechanism $C_y$ times D (see FIG. 4 and FIG. 10(*a*)), or $M_y=C_y\times D$.

Figure 6A:
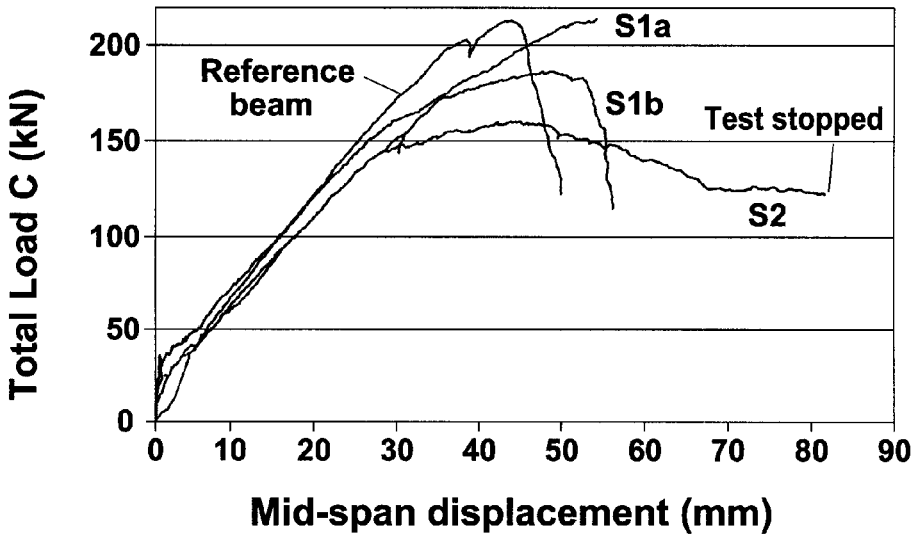
Figure 6B:
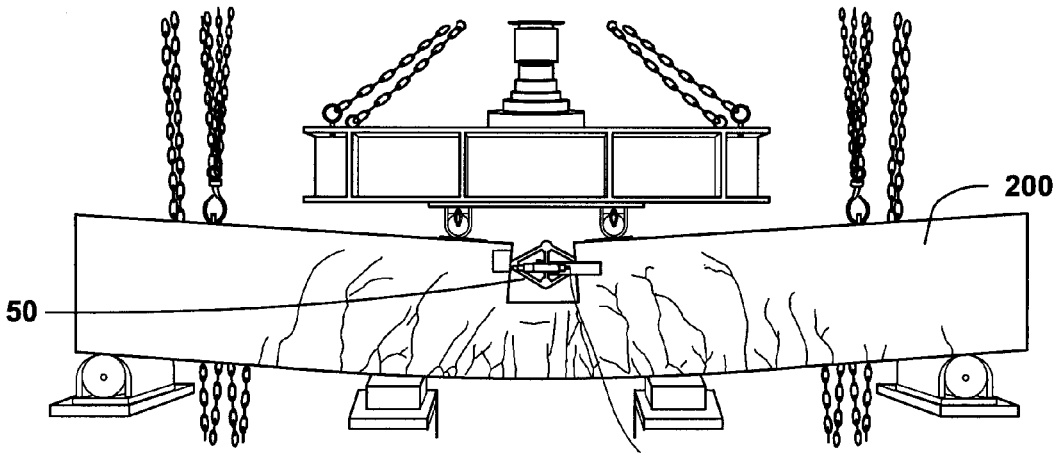
FIG. 6*b* illustrates the setup in Example 3 after the test had concluded.
Figure 7:
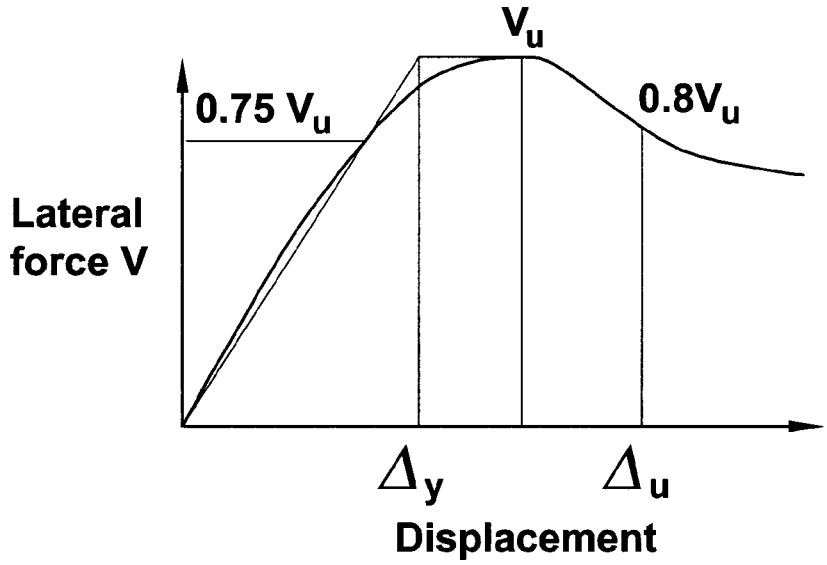
FIG. 7 is a graph depicting the parameters of the definition of ductility in the context of this invention.
Figure 8:
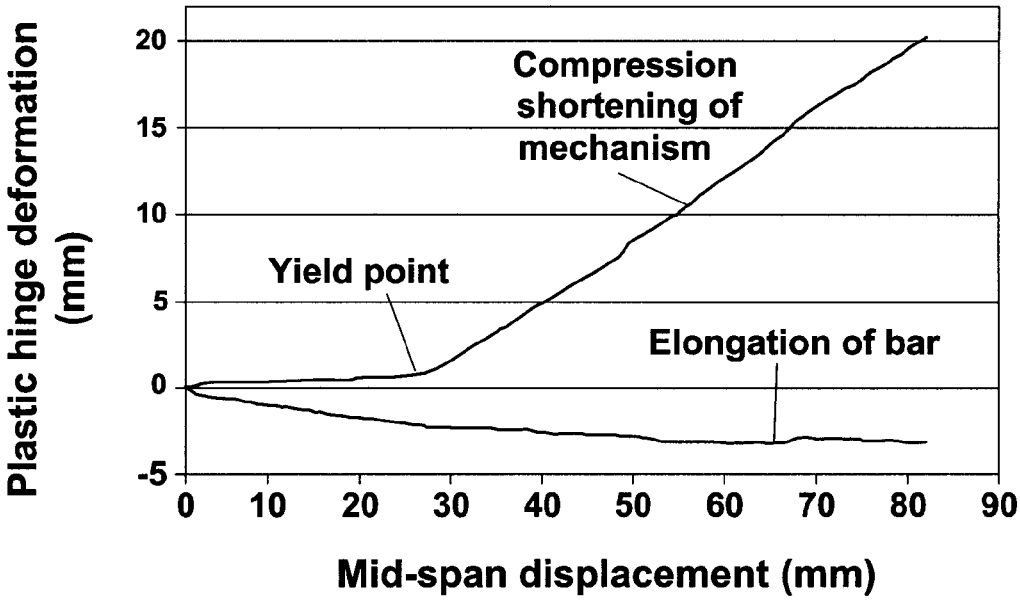
FIG. 8 is a graph showing the measured plastic hinge deformation in Example 3, with the elongation of the bar showing the tensile deformation of reinforcement bars, and compression shortening of the mechanism showing the compression deformation, within the plastic hinge zone.

From FIG. 9 of the measured deformation curve of the mechanism in Example 3, the plastic deformation $\delta_p$ is found to be about 20 mm at the mid-span displacement of 82 mm that corresponds to the ductility factor of 2.75. The theoretical value of $\delta_p$ can be calculated by Eq. 8 as $$\delta_p = \frac{4\times(2.75-1)\times 29.8\times 240}{2300-\frac{200}{2}} = 22.7(\text{mm})$$

in which the yield displacement, $\Delta_y$=29.8 mm, is obtained from the response curve in FIG. 6(*a*) in accordance with the definition in FIG. 7. This value of $\delta_p$ is reasonably close the test result of about 20 mm. Total elongation of the GFRP bars inside the plastic hinge zone at the corresponding displacement is about 3 mm as shown in FIG. 8. This tensile deformation is relatively small compared to the compression deformation of the plastic hinge.

With the above theory, the ductility design of the compression yielding members is simpler than that with the conventional reinforced concrete theory.

The following examples are used to illustrate how the described invention is put into practice, and are not intended to restrict the scope of the claims in any way. A skilled person would understand that certain materials used in the invention could be substituted for other materials with similar desired properties. For example, where steel is used in the ductile compressive mechanism 50, a skilled person would realize that other materials having similar properties (and also used in buildings and structures) might be equally useful in the invention.

EXAMPLES

Experimental tests were conducted to investigate the effectiveness of the new ductility scheme. One reference beam 100 and two compression yielding beams were tested. Glass fiber reinforced polymer (GFRP) bars 18*a*, were used as the tension reinforcement in all the three specimens. More specifically, in this particular example, 3ϕ16 GFRP bars were used.

Figure 3A:
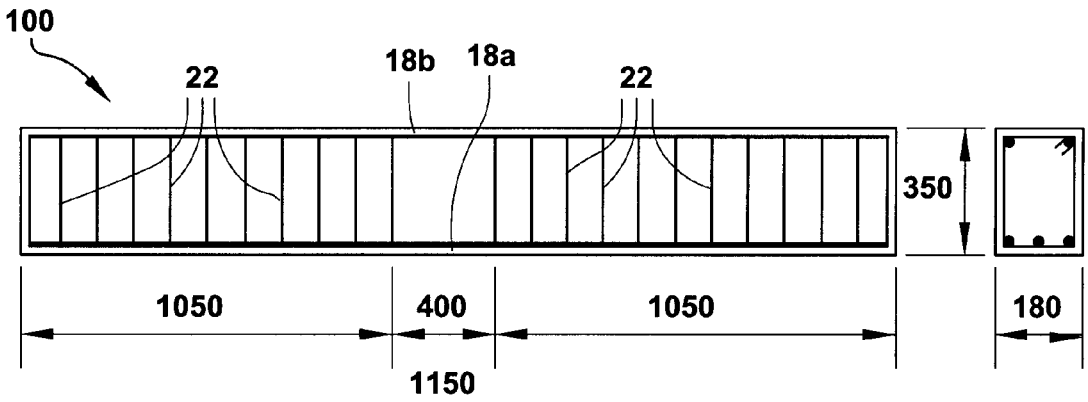
FIGS. 3*a* and *b* show an elevation detail of tested specimens, with FIG. 3*b* showing the reinforced concrete beam containing a ductile compression mechanism, and FIG. 3*a* showing the reference beam constructed by a conventional method.
Figure 3B:
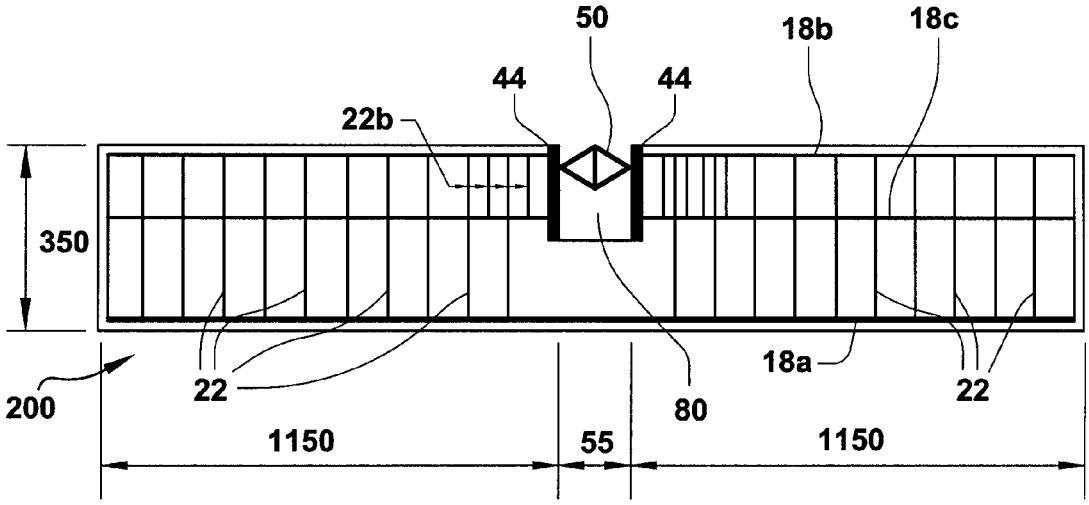

The reference beam 100 shown in FIG. 3*a*, was a normal GFRP reinforced concrete beam. In order to avoid the sudden break of the GFRP bars, the beam was designed to be slightly over-reinforced (i.e. the tensile resistance of the beam was slightly higher than the compression resistance of the concrete at a cross-section). The overall dimensions and tension reinforcement of the compression yielding beams 200 were identical to that of the reference beam 100, shown in FIG. 3*b*. Sufficient stirrups 19 were used in both the reference beam 100 and the compression yielding beam 200 to avoid a shear failure. More specifically, reference beam 100 utilized 2 R12 steel bars as reinforcement bars 18*b* and R-12 links at 100 c/c as reinforcement links 22 (See FIG. 3*a*). Reference beams 200 utilized 2 T20 steel bars as reinforcement bars 18*b*; 2T16 steel bars as bars 18*c*; R-12 links at 100 c/c as reinforcement links 22; 4 R10 closed links at 50 c/c as reinforcement links 22*b*; and 180×150×20 mild steel plates as plates 44 (See FIG. 3*b*).

Ordinarily, the ductile compression block 60 (either made up of a ductile material 30 or a mechanism 50), should be prefabricated and then cast into the beam like a fitting. The test beam 200 was made by casting a 200 mm deep polystyrene block (not shown) into the top of the plastic hinge zone 20. This polystyrene block was removed when sufficient strength developed in the concrete 15 to provide a void 80 that would be used to install a suitable compression yielding device for testing. In this way, all the compression yielding specimens could be cast in the same way regardless of the details of the compression yielding device.

The material properties of concrete, steel and GFRP reinforcing bars, and steel plate are provided in Table 1.

TABLE 1

Material properties

| Material | | Strength (MPa) | Young's Modulus ($\times 10^3$ MPa) |
|---|---|---|---|
| Concrete | R1 | $f_{cu}$ = 64.9 | — |
| | S1 | 79.8 | |
| | S2 | 80.4 | |
| T16 steel bar | | $f_y$ = 548 | — |
| T20 steel bar | | $f_y$ = 690 | — |
| Mild steel bar | | $f_y$ = 307 | — |
| GFRP bar | | $f_{fu}$ = 655 | 40.8 |
| Mild steel plate | | $f_y$ = 325 | 200.3 |

Note:
R1 is the reference beam;
S1 and S2 are the compression yielding Example 2 and Example 3, respectively;
$f_{cu}$ is the cube compressive strength at the time of beam testing;
$f_y$ is the yield strength; and
$f_{fu}$ is the guaranteed tensile break strength.

Materials

Figure 2B:
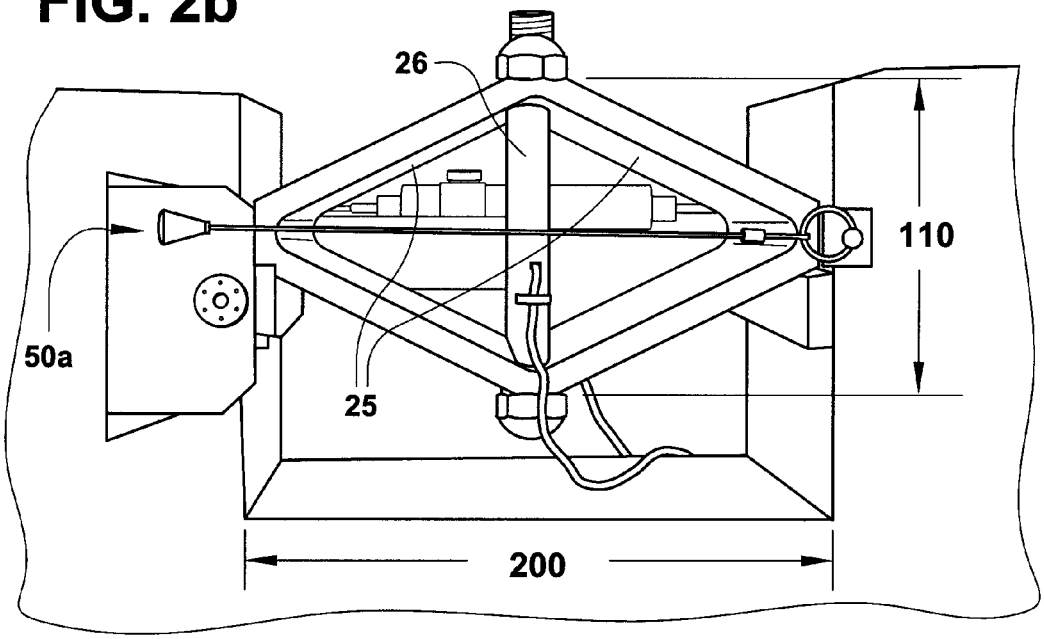

In the first trial, a simple steel mechanism 50*a* was used to investigate the effectiveness of the scheme. The design of this steel mechanism 50*a* is as shown in FIG. 2*b*. It can be seen clearly from the ideal model of FIG. 2*a* that the relation between the longitudinal displacement 4 and the compression force C is essentially elasto-plastic if the stress-strain relation of the web steel member 53 is elasto-plastic. It should be noted that "elasto-plastic" refers to a load-deformation relation where there is an elastic stage in which the deformation is in direct proportion to the load, followed by a plastic stage in which the deformation increases though the load remains constant. A mild steel plate was used to make the web member 53, and therefore, the stress-strain relation could be considered as approximately elasto-plastic. Referring to FIG. 2*b*, a first steel mechanism 50*a* was made from two 10 mm thick by 150 mm mild steel plates 25 that were bent and welded together at their ends. Four 12 mm mild steel bars 26 were used as the web member 53 that penetrated through and were bolted into the middle of the two bent steel plates 25, as shown in FIG. 2*b*. The middle of the two plates 25 was grinded to reduce their thickness in order to reduce the moment resistance of the plate 25 at the joint. This mechanism relied on the ductile elongation of the web member 53 to provide ductile compressive deformation of the mechanism 50*a*. It was found in the test that this mechanism 50*a* (FIG. 2*b*) did not work well due to the insufficient elongation capacity of the web member 53.

Figure 2C:
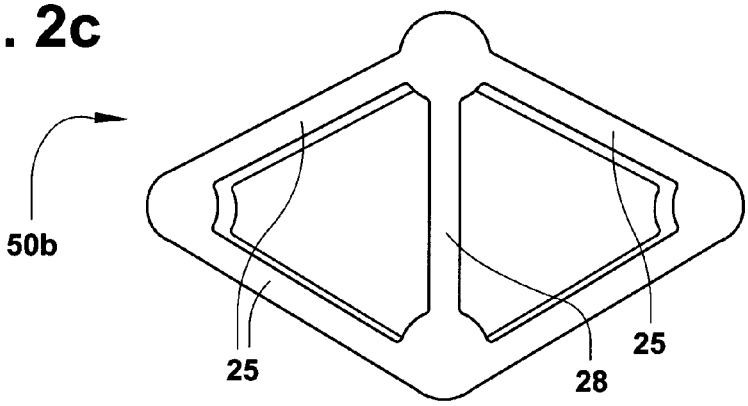
Figure 4:
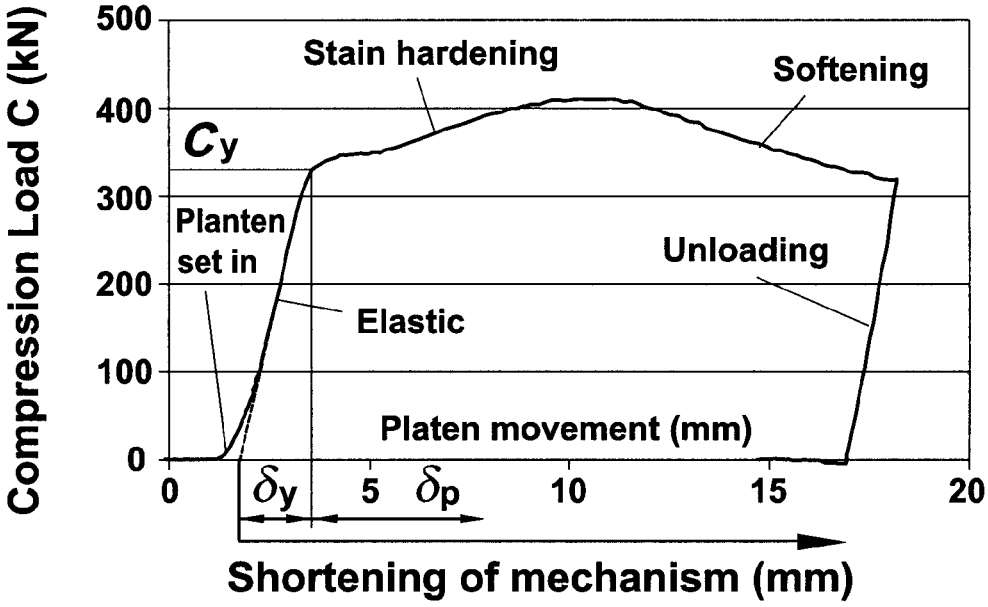
FIG. 4 shows the load vs. deformation curve for the test results of the mechanism used in Example 3.

The second steel mechanism 50*b* is shown in FIG. 2*c*. On the face of it, this mechanism may seem similar to that shown in FIG. 2*b*. However, it worked in a completely different way. Instead of relying on the tensile elongation of the web member 53 to provide compression shortening of the mechanism 50*b*, it relied on the compressive plastic buckling of the two chord plates 25 to provide the plastic shortening of the mechanism 50*b*. The tensile yielding of the web was prevented by using a 10 mm thick mild steel plate 28 as the web member 53. The load vs. displacement response of this mechanism 50*b*, with a steel plate 28 having a width of 70 mm, was obtained by compression test in a universal compression machine. An approximately elasto-plastic response was obtained which is shown in FIG. 4.

Test

Figure 5:
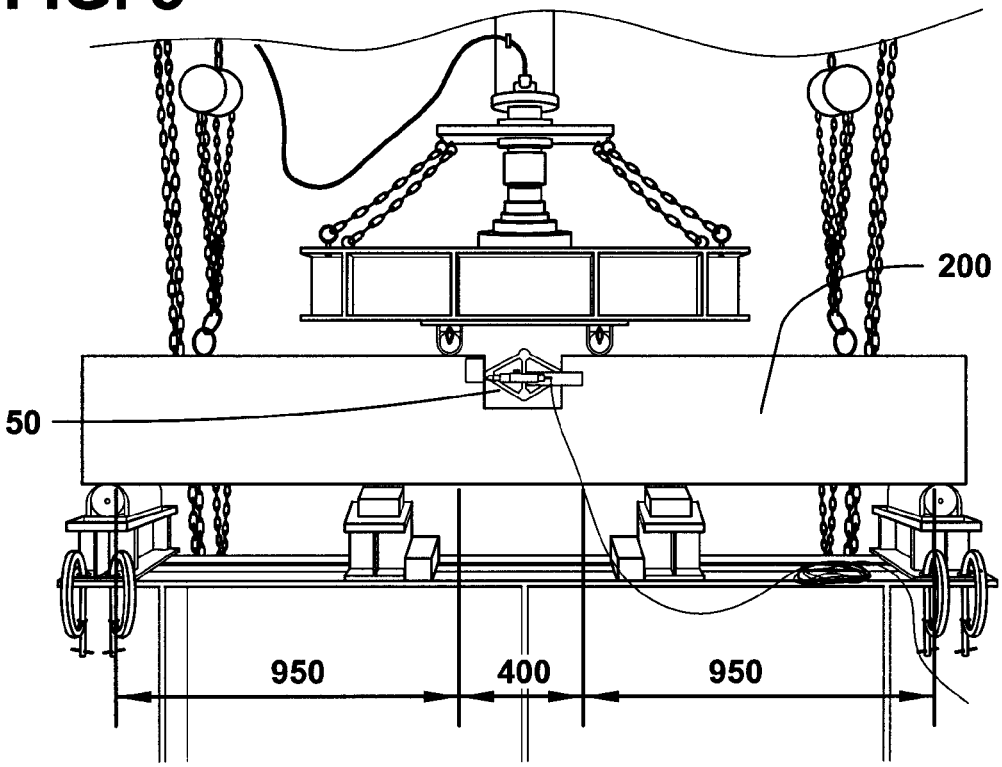
FIG. 5 illustrates the test setup used in the Examples.

Beams 100 and 200 were tested under 4 points bending. The test set-up is shown in FIG. 5. Test instrumentation included the load cell that measured the total applied load F from the load cell and the linear variable differential transformer LVDT 1 that measured the displacement at the bottom of the mid-span, as shown in FIG. 5. Strain gauges were mounted onto the GFRP bars 18*a* at the mid-span to measure the tensile strain of the bars. For compression yielding beams 200, the second transducer LVDT 2 was used to measure the displacement or the shortening of mechanism 50. Strain gauges were also mounted onto the web 53 of the steel mechanism as shown in FIG. 2(*b*).

Testing was conducted under a displacement control mode. In a test, the hydraulic jack at the top of the test-rig applied a displacement increment to the specimen. Responses including load, displacements and strains were recorded automatically. The specimen was then visually inspected and cracks were marked. When all the information was obtained for a displacement step, a new displacement increment was applied, and so on.

The reference beam 100 failed due to concrete crushing, after which the load dropped quickly (see FIG. 6*a*).

The load vs. mid-span displacement curve is given in FIG. 6*a*.

Example 1

In the first compression yielding beam test, steel mechanism 50*a* (see FIG. 2*b*) was used in a first compression yielding beam 200*a*. However, the test failed due to the breaking of the web bars 26 at the bolt joint 32, although significant yielding of the web bars 26 had occurred which was recorded from the strain gauge reading. Yield plateau of the load vs. mid-span displacement curve, as indicated in FIG. 6*a* by "S1*a*", had not developed before the breaking of the web bars 26. The elongation capacity of the web bars 26 was not sufficient to cater for this significant deformation of the mechanism 50*a*.

Example 2

In the second compression yielding test, steel mechanism 50*b* as shown in FIG. 2*c* was used in second compression yielding beam 200*b*. The response curve is show in FIG. 6*a* by "S1*b*". This test resulted in the breaking of the tension GFRP bars 18*a*. Significant yield plateau of the response curve had already occurred, and the steel mechanism 50*b* had yielded. The tension bar 18*a* broke when the steel mechanism 50*b* worked in its strain hardening part of its load vs. deformation curve, as show in FIG. 4.

Example 3

The third compression yielding beam 200*c* was tested using the same mechanism 50*b* as that used in the second compression yielding beam 200*b*. However, in order to ensure no breaking of tension bars 18*a*, the width of the steel plate 28 was reduced from 70 mm to 59 mm. This beam performed satisfactorily (see FIG. 6*b*) and a large yield plateau was achieved. The response curve is shown in FIG. 6*a* by "S2".

Discussion of Experimental Results

The ductility factor of a member, μ, is defined as the ultimate displacement divided by the yield displacement, or $$\mu = \frac{\Delta_u}{\Delta_y} \tag{1}$$

Different definitions of yield and ultimate displacements were used in the literature. In this work, the ultimate displacements $\Delta_u$ is defined as the point on the softening branch of the actual response curve where the strength drops 20% of its peak value, as shown in FIG. 7. The yield displacement $\Delta_y$ is the yield point of an equivalent bilinear response curve defined in FIG. 7.

With this definition the ductility factor of the reference beam is calculated to be 1.2, and that of the compression yielding beam in Example 3 to be 2.75. Clearly, a significant increase in ductility has been achieved by using the compression yielding mechanism. In fact, the compression yielding beam continued to take a significant load at the last point of the test curve where the test stopped due to a problem with the test rig at large displacement.

The response curve of Example 2 is very similar to that of Example 3 before the breaking of the tension reinforcement. A similar response to that of Example 3 would have been obtained had the total compressive resistance of the mechanism been smaller than the tensile resistance of the GFRP bars. For this reason the width of the steel mechanism 2 was reduced for Example 3. This test also illustrated the catastrophic nature of the tension failure mode. With the compression yielding scheme, the tensile failure can be easily avoided by ensuring the compression resistance to be smaller than the tensile resistance. The tension failure cannot always be avoided with the most common method of providing confinement, because confinement increases not only ductility of concrete but also the strength of the concrete that increase the risk of breaking the tension bars.

The rotation of the plastic hinge 20 mainly comes from the plastic shortening of the compression yielding zone 40. The contribution from the elongation of tension bars 18*a* is relatively small at large displacement. This is illustrated by the measured deformation of the plastic hinge 20 of Example 3 as shown in FIG. 8. The compression shortening of the mechanism 50 was directly measured in the test. The elongation of the bars was obtained from the measured strain of the reinforcement bars 18*a* at mid-span multiplied by the plastic hinge length 55 of 200 mm. The figure shows that the deformation of GFRP bars 18*a* was greater than that of the compression mechanism 50 before yielding. The compression deformation increased quickly and linearly after the yielding point whereas the tension deformation of the plastic hinge 20 essentially kept unchanged. The compression deformation was almost ten times that of the tensile deformation at the maximum mid-span displacement of 82 mm. FIG. 9 shows the variation of the compression shortening of the mechanism 50 against the applied beam load.

The strain of the GFRP bars 18*a* of Example 3 reached 0.015 at the maximum displacement. Therefore, the strain capacity of the GFRP bars 18*a* was almost fully utilized in the test beam. Bearing in mind that the Young's modulus of the GFRP bars is relatively small compared to steel or CFRP (carbon fiber reinforced polymer) bars, a beam with steel or CFRP bars would have achieved a smaller elongation of the reinforcement than that of this test beam. These analyses show that the deformation/ductility contributed by tension straining is very limited and a significant ductility demand cannot be satisfied without significant compression deformation/yielding for beams reinforced with non-ductile reinforcement.

REFERENCES

ACI Committee 440, *Guide for the Design and Construction of Concrete Reinforced with FRP Bars*, American Concrete Institute, Farmington Hills, 2001.

Bayrak, O. and Sheikh, S. A. (1998). "Confinement reinforcement design consideration for ductile HSC columns". *Journal of Structural Engineering, ASCE;* 124: 999-1010.

Bayrak, O. and Sheikh, S. A. (1997). "Earthquake resistance of 100 MPa concrete columns". *Proc. 1st International conference High Strength Concrete*, Jul. 13-18, 1997, Kona, Hi., 122-135.

Berwanger, C. (1975). "Effect of axial load on the moment-curvature relationship of reinforced concrete members". *ACI SP* 50-11, pp. 263-288, American Concrete Institute, Detroit.

CEB Task Group 2.2. (1998). *Ductility of Reinforced Concrete Structures*.

Diniz, S. M. C. and Frangopol, D. M. (1997). "Strength, Ductility and reliability of HSC columns". *Proceedings of First International Conference on High Strength Concrete*, ASCE, 1997, pp. 187-200.

Foster, S. J. and Attard, M. M. (1997). "Ductility and strength in HSC columns". *Proceedings of First International Conference on High Strength Concrete*, ASCE, 1997, pp. 201-214.

Goodfellow, R. C. and Elnashai, A. S. (2000). "Ductility of RC Members Constructed from High Strength Concrete and Reinforcing Steel". *ESEE Research Report No.* 3-2000, Civil and Environmental Engineering Department, Imperial College, London.

Hulatt, J. A., Hollaway, L. C. and Thorne, A. (2004). "A novel advanced polymer composite/concrete structural element". *Proceedings of the Institution of Civil Engineers—Structures and Buildings,* 157 (1): 9-17.

Mander, J. B., Priestley, M. J. N. and Park, R. (1988). "Theoretical stress-strain model for confined concrete". *Journal of Structural Engineering*, ASCE, 114(8): 1804-1826.

Naaman, A. E. (2003). "FRP reinforcements in structural concrete: assessment, progress and prospects". *Proceedings of the Sixth International Symposium on FRP Reinforcement for Concrete Structures*, World Scientific, Singapore, pp. 1-24.

Nanni, A. (2003). "North American design guidelines for concrete reinforcement and strengthening using FRP: principles, applications and unresolved issues". *Construction and Building Materials,* 17(6-7): 439-446.

Park, R. and Paulay, T. (1975). *Reinforced Concrete Structures*. John Wiley & Sons, New York.

Paulay, T. and Priestley, M. J. N. (1992). *Seismic Design of Reinforced Concrete and Masonry Buildings*, John Wiley and Sons, Inc.: New York.

Priestley, M. J. N. and Park, R. (1987). "Strength and Ductility of Concrete Bridge Columns under Seismic Loading". *ACI Structural Journal,* 84 (1): 61-76.

Purba, B. K. and Mufti, A. A. (1999). "Investigation of the behavior of circular concrete columns reinforced with carbon fiber reinforced polymer (GFRP) jackets". *Canadian Journal of Civil Engineering,* 26 (5): 590-596.

Saatcioglu, M. (1997). "Behaviour and design of confined high-strength concrete columns". *Proceedings of First International Conference on High Strength Concrete*, ASCE, 1997, pp. 173-186.

Saatcioglu, M. and Razvi, S. R. (1998). "High-strength concrete columns with square sections under concentric compression". *Journal of Structural Engineering, ASCE;* 124: 1438-1447.

Sheikh, S. A. and Khoury, S. S. (1993). "Confined concrete columns with stubs". *ACI Structural Journal,* 90(4): 414-431.

Teng, J. G., Chen, J. F., Smith, S. T. and Lam, L. (2002). *FRP Strengthened RC Structures*, John Wiley & Sons Ltd, UK, 245 pp.

Theriault, M. and Neale, K. W. (2000). "Design equations for axially loaded reinforced concrete columns strengthened with fibre reinforced polymer wraps". *Canadian Journal of Civil Engineering,* 27 (5): 1011-1020.

Warner, R. F., Rangan, B. V., Hall, A. S. and Faulkes, K. A. (1998). *Concrete Structures*, Longman Group Limited, 1998, Australia.

Watson, S. and Park, R. (1994). "Simulated seismic load tests on reinforced concrete columns". *Journal of Structural Engineering*, ASCE, 120(6): 1825-1849.

Watson, S., Zahn, F. A. and Park, R (1994). "Confining reinforcement for concrete columns". *Journal of Structural Engineering*, ASCE 1994, 120(6): 1798-1824.

Wu, Y. F., Oehlers, D. J. and Griffith, M. C. (2002). "Partial interaction analysis of composite beam/column members". *Mechanics of Structures and Machines,* 30(3): 309-332.

Xiao, Y. and Martirossyan, A. (1998). "Seismic performance of high-strength concrete columns". *Journal of Structural Engineering*, ASCE, 124(3): 241-251.

What we claim is:

1. A reinforced structural flexural member made of reinforced concrete comprising a concrete beam or column having a plastic hinge portion at or near the maximum moment region defined by a tension zone and a compression zone existing simultaneously when subject to a bending moment under loading on the member, wherein;

a) at least a portion of material within the compression zone of the plastic hinge portion comprises a ductile compressive material which is elasto-plastically or nearly elastoplastically deformable, the ductile compressive material being selected from the group consisting of metallic materials, cementitious materials, rubber cement materials, composite materials, elastomeric materials, or a combination thereof, wherein voids or bubbles are provided in the ductile compressive material to increase ductility;

b) concrete material adjacent to the compression zone having a compressive strength higher than a compressive strength of the ductile compressive material, said ductile compressive material having greater ductility than said adjacent concrete material, and said ductile compressive material is limited to the compression zone in the plastic hinge portion;

c) a total compressive strength of the flexural member is not greater than a total tensile strength of the flexural member for preventing tensile rupture; and d) the ductile compressive material assumes a substantially block-shaped configuration and plastic deformation is mainly concentrated in the ductile compressive material of the plastic hinge to maintain an adequate load carrying capacity before structural failure.

2. A member according to claim 1 wherein the ductile compressive material is prefabricated into a block shape and cast or installed into said flexural member.

3. A member according to claim 1 wherein the member further comprises additional compression bars or compression plates in the compression zone.

* * * * *